US005819576A

United States Patent [19]

Smith, Jr.

[11] Patent Number: 5,819,576

[45] Date of Patent: Oct. 13, 1998

[54] SNOWMOBILE STRAIGHTENING REPAIR SYSTEM

[76] Inventor: Curtis A. Smith, Jr., 21 Curtis Dr., Sydney, Me. 04330

[21] Appl. No.: 794,583

[22] Filed: Feb. 3, 1997

[51] Int. Cl.[6] ..... B21D 11/00

[52] U.S. Cl. ..... 72/311; 72/457; 72/705

[58] Field of Search ..... 72/293, 308, 311, 72/372, 457, 705

[56] References Cited

U.S. PATENT DOCUMENTS

| | | | |
|---|---|---|---|
| D. 281,072 | 10/1985 | Hunt . | |
| D. 300,748 | 4/1989 | Jarman et al. . | |
| D. 319,523 | 8/1991 | Hall . | |
| 4,530,232 | 7/1985 | Smith | 72/705 |
| 4,700,559 | 10/1987 | Larson et al. | 72/705 |
| 4,823,589 | 4/1989 | Maxwell, Jr. et al. | 72/705 |
| 5,014,538 | 5/1991 | Eltvik | 72/705 |
| 5,189,899 | 3/1993 | Hsu . | |
| 5,211,265 | 5/1993 | Gregg . | |
| 5,335,533 | 8/1994 | Rehus . | |

*Primary Examiner*—Joseph J. Hail, III
*Assistant Examiner*—Ed Tolan
*Attorney, Agent, or Firm*—Stan Jones, Patents

[57] ABSTRACT

Self-contained snowmobile straightening system with a repair table. The table includes a two-location anchoring system assuring that both the chassis and the suspension of the snowmobile are immobilized in place on the table so that repair work can be accomplished by adjustable and removable pulling equipment structurally associated with the repair table. The chassis is immobilized in place by at least one pair of opposed slide rail clamps which lock both slide rails of a snowmobile in place on the table surface of the straightening system. The snowmobile suspension system is anchored by opposed pairs of running board clamps, while pulling towers and braces, in combination with hydraulic power rams, afford a repair craftsman many necessary multi-directional pulls.

22 Claims, 6 Drawing Sheets

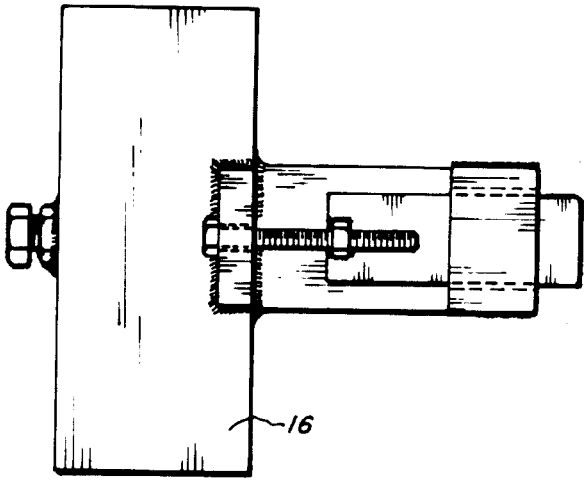
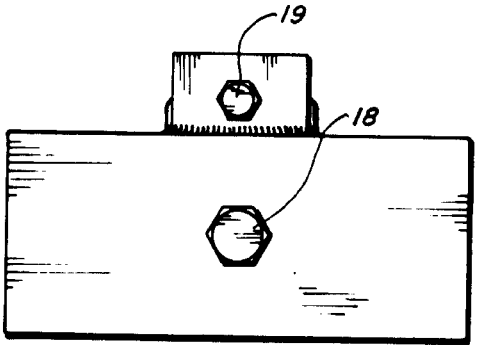
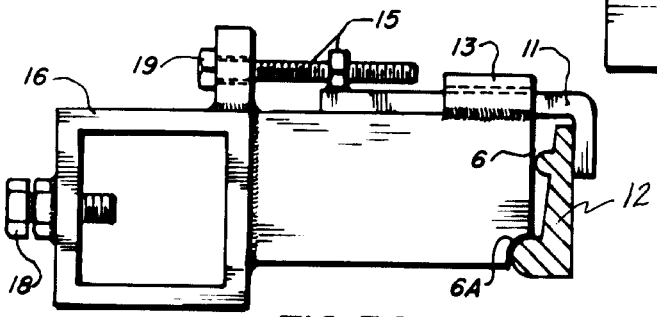
FIG. 3C
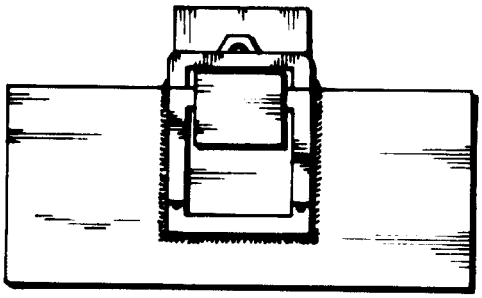
FIG. 3B
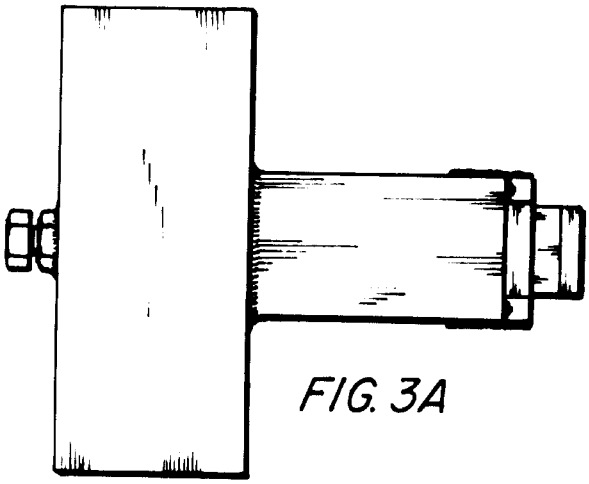
FIG. 3A
FIG. 3

SNOWMOBILE STRAIGHTENING REPAIR SYSTEM

BACKGROUND OF THE INVENTION

1. Field of the Invention

The field of the invention relates to a method and apparatus for straightening damaged snowmobiles. In a more limited sense, the field of the invention relates to a flat bed repair frame which positions and holds a damaged snowmobile in place while providing a series of pulls from many different angles in order to restore the damaged snowmobile to useable condition.

More specifically the field of the invention relates to a self-contained working frame having a flat bed anchoring table that is equipped with pulling towers and adjustable, peripherally-located pulling and anchoring braces which may be removed and inserted by a repair craftsman in spaced openings located around the working frame.

Definition of Terms

It is believed helpful to introduce certain terms that will promote a clearer understanding of this most important breakthrough in the art of snowmobile repair. Such terms are defined below.

Snowmobile Chassis.

The chassis is the main frame of a snowmobile and includes the slide rails which receives a track for mobilization. The slide rail portion of the chassis is one of the locations for a two-location anchoring system of my invention.

Slide Rail Clamp.

An adjustable clamp slidably mounted on a flat bed frame and adapted to receive and anchor the slide rail in order to immobilize the snowmobile chassis in place on a working surface of the straightening system.

Clamp Rail Bar.

A working table surface receives a damaged snowmobile and a lateral rear bar receives a pair of collars each having a longitudinal rail lying slightly above the working surface and extending forward the length of a snowmobile placed upon the table surface. Such longitudinal rail bars holds adjustable slide rail clamps for anchoring the slide rail and thus the snowmobile chassis when pulls are to be applied.

Rear Clamp Bar

A bar sliding through the rear of the clamp rail bar thus holding rail bars securely on the steel bed working table when a forward pull is going to be exerted.

Running Board Clamp.

A snowmobile includes a suspension system that accommodates up and down movement during travel. Such freedom of movement must be stabilized and fixed in position during repair operations. Each side of a snowmobile includes running boards, and such running boards are held by at least a pair of opposed adjustable clamps mounted on side braces held in openings around the periphery of the working table.

Two Location Anchoring.

In order for repair work to proceed in an expeditious manner the invention provides for two-location anchoring. Both the chassis and the suspension are immobilized by clamps that lock the snowmobile in place on the working table.

Bracing Members.

These include box steel angle braces that are, in some cases, double side-by-side construction in order to rigidly hold clamps in place so that a two-location anchor approach will satisfactorily immobilize the snowmobile on the table surface for repair purposes. Such bracing members are adjustable, removable and in many cases provides several degrees of freedom for flexibility in adjustments as required. Bracing for the running board clamps must be double and side by side in order to prevent any twisting of the snowmobile frame as repair is ongoing.

Pulling Towers.

A Pair of these towers are located on the front end of the working table and are adjustable in rotation at about 270° in order to provides a wide latitude in direction of angular pulls on the snowmobile. Such towers are also adjustable by angular amounts relative to a vertical axis along the tower mount. Such towers each include a pair of hydraulic rams—one ram being the ram for pulling and the other ram being available for angular adjustment of the tower. Associated with such towers are chains, ram controls hoses, pulleys and the like for delivering pulling or adjusting force as required.

2. Description of Prior Art

Frame straightening equipment has been developed over the years for holding automobiles in place while various pulls are placed on damaged portions of the frame and body. This equipment is usually in the nature of a pair of tire receiving rails that have the automobile physically located on the straightening apparatus. Chains and clamps are used to tie the automobile down to the bed, and various other clamps and pulling chains are used to place high powered pulls on the damaged area until the damage is restored.

While automobile straightening is, of course, a recognized and long standing trade, such equipment is not generally satisfactory for straightening snowmobiles, or "sleds". The frame, chassis and damage areas on a snowmobile, in comparison to an automobile, simply are not equivalent. Moreover, the various makes of sleds adds a diversity not seen in automobile frames. For these reasons the type of anchoring and pulling equipment used for automobiles is usually unsatisfactory for working on the more flexible and less bulky frames and chassis for a snowmobile. Indeed a damaged snowmobile presents its own set of characteristics that have heretofore been unsolved by any self-contained damage repair system.

My research and development for the type of shop equipment that is suitable for snowmobile damage repair has led to a system that is self contained and entirely satisfactory for the many and varied pulls as needed to repair such vehicles. A report concerning my research and development work appeared in an article in a local newspaper, copy attached. To the extent that this published article may be interpreted to say that my research and development was finished, that interpretation in not correct. Because my invention was in a development stage, and the snowmobile season is short, I continued inventing and testing on various snowmobile types and damage issues as they presented themselves until the invention achieved desired results.

While the article does include some inaccuracies, the newspaper article does foretell and correctly acknowledge that once-non-repairable sleds can now be saved by use of my invention. The reported nature of the problem I faced is fairly stated by a State Farm representative who is quoted as saying that his company was then handling "between 50 to 60 snowmobile claims per year, of which about 70 percent are totalled." Obviously the article presented an unsolved problem that my invention has now cured.

Prior to completion of my invention it was known to try snowmobile repairs by use of automobile straightening devices. Such devices would let the sled slip as pulls were applied. These automobile straightening repair devices were designed for a different problem and used different principles. They simply did not work satisfactorily for snowmobile straightening and repair.

My research led to an important two-location anchoring system that sufficiently holds the snowmobile in place on a working table in such a position that various directional pulls can be successfully used to repair snowmobiles that otherwise would have been declared as non-repairable. My two-location anchoring system has two-tiers with the potential of utilizing four opposed pairs of snowmobile clamps.

A search was done regarding my invention and the results of that search showed that I was perfecting an invention in a newly developing area that did not have much in the way of available prior art. That search has disclosed a number of related references, most of marginal relevance, which references will be discussed below. Generally speaking, however, the references disclose a diverse number of method and apparatus for automobile repair. However, none of the search references demonstrate the novel features of this invention which provide a two-location anchoring system that permits peripheral direction pulls while preventing the snowmobile from moving on a working bed as pulls are being applied.

The prior art developed by the search included the following patents:

| | | |
|---|---|---|
| 5,189,899 | Mach 2, 1993 | Hsu |
| 5,211,265 | May 18, 1993 | Gregg |
| 281,072 | October 22, 1985 | Hunt |
| 319,523 | August 27, 1991 | Hall |
| 300,748 | April 18, 1989 | Jarman et al |
| 5,335,533 | August 9, 1994 | Rehus |

Taking the patents of the search listed above, Hsu, Jarman et al and Rehus deal with automobile straightening apparatus and such devices simply will not work for snowmobiles, nor do they teach or suggest a two-location anchoring/pulling system such as my invention.

Hall discloses a design patent that has a three direction chain pulling clamp for attachment to an automobile door and is not at all relevant to my invention. Hunt is another design patent that shows a four post vehicle rack that is not relevant to my invention.

The patent to Gregg involves a snowmobile lift that utilizes a scissor-type cross rail that lifts a snowmobile so that the skis and track of the snowmobile are suspended and thus available for servicing or repair. In my invention I seek to have the snowmobile placed on my table and fastened thereto with a two-location, two tier anchoring system. Gregg does not teach at all in that direction. Indeed the manner of suspension of Gregg patent goes contrary to my teachings.

In summary, when one examines all of the prior art, one finds that they may attempt to solve one or two pull or anchor problems either separately or collectively. None, however suggest the multi-location anchoring purposes of this invention nor the various attachments for achieving a secure working surface against which my various directional pulls may readily be achieved.

In short, snowmobile repair, can be—and has been—a time consuming and frustrating proposition. Although a problem of long standing, the prior art simply has not offered a ready and simple solution to this problem. This invention offers such a solution based upon a novel method and apparatus which solve this long standing and unsolved problem.

SUMMARY OF THE INVENTION

A self-contained snowmobile straightening repair system includes a working table for receiving a snowmobile to be repaired. The repair system includes two-location anchoring which assures that both the chassis and the suspension of the snowmobile are immobilized so that repair work can be accomplished by pulling equipment associated with the repair system. The chassis, the main frame of a snowmobile, is immobilized by at least one pair of opposed slide rail clamps which lock both slide rails of a snowmobile chassis in place along clamp runs fixed in position on the working table surface. This slide rail portion of a snowmobile chassis is one of the locations for a novel two-location anchoring system provided by my invention.

A snowmobile includes a suspension system that accommodates up and down movement during travel. Such freedom of movement must be stabilized and fixed in position during repair operations. Each side of a snowmobile body includes running boards, and such running boards are held in place by at least a pair of opposed adjustable running board clamps mounted on side braces held in openings around the periphery of the working table.

Bracing members, preferably in the form of box steel angle braces, are removed and fitted in place around the periphery of the repair frame working table. Such members, in some cases, consist of double side-by-side construction in order to rigidly hold my two-location anchor clamps in place. Such members and clamps in combination satisfactorily immobilize the snowmobile on the table surface for repair purposes. These bracing members are adjustable, removable and in certain specified locations provides several degrees of freedom in order to provide for increased flexibility in anchoring and/or pulling adjustments as required. Bracing for the running board clamps, in particular, should be of a double, side-by-side configuration in order to prevent any twisting of the snowmobile frame as repair is ongoing.

A pair of upright pulling towers are structurally incorporated at circular tracks located at the front end of the working table. Such upright towers may each be adjusted in rotatable direction through about 270° of movement on circular shaped, segmented mounting tracks. The rotational movement afforded such towers provides a wide latitude in angular pulls on the snowmobile.

Each of these pulling towers are also angularly adjustable by any desired angular amount relative to a vertical axis along the tower's mounting location. An adjustable, yoked change of direction chain pulley feeds the pulling chain at a selected height and angle for either an upright or angled tower. A pair of hydraulic rams are carried by each tower—one ram controllably supplies a pulling force, and the other ram controllably sets and holds the angular adjustment of the tower in order to precisely locate the height and direction of a repair pull as desired.

As can be appreciated, the crash damage to high speed snowmobiles can be considerable and at varying locations. Such vehicles are characterized by lightweight and rather flimsy materials so that they may attain high speeds with relatively low horse powered engines. Should an accident cause damage to the front portion of a snowmobile, my invention provides an adjustable fulcrum bar that can be placed under the sled chassis frame and just in front of the track. That fulcrum bar then acts as a lateral wedge to hold the front of the snowmobile immobile, while I develop varying angled pulls from different height and spacial locations by use of my upright and adjustable towers.

In a similar manner, should an accident cause damage to a running board area, the clamping braces at that area may be removed while the other three running board clamps and the four slide rail clamps anchor the snowmobile in place on the flat bed table. In such an instance, the repair pulls are applied to the damaged running board area that is aligned with the normal location of the missing running board clamp and outrigger bracing.

I have also developed additional mounting braces for a several-direction side pull. Again, for this particular pull application, a change of direction pulley can be adjusted both in height and in longitudinal location along an outrigger side rail that is inserted at appropriate openings provided along the work table.

In some particular makes of snowmobiles, the shock absorbers will not stand the bending forces needed for repair so I have discovered that it is advantageous to first remove those shocks. And, in my invention, I have provided a strut replacement bar for the removed shock. That strut bar is adapted to receive chains and clamps needed for front end repair and it will readily withstand the pulling force needed. After the damaged area has been repaired by my invention, the costly shock absorber may be re-installed. This technique and aspect of my invention lowers repair costs and inconvenience.

Additionally, I have used the box steel support frame which underlies my working repair table as a cooling and circulating reservoir system for the hydraulic fluid system required by the pulling and positioning rams. The front end of my frame/working table has a lift lid that conceals a front frame area which houses the hydraulic pumps motor, hoses, and filtering supply required for driving/controlling the various pulling rams. Hydraulic controls are connected to various hoses in any well known manner.

In short summary then, what I have perfected is a new and novel method and apparatus that consists of a three dimensional self-contained pulling method and system that is used in combination with a two-location anchoring/working table. While my invention is particularly applicable to snowmobiles, it is not so limited. I have successfully used my apparatus on various types of smaller terrain vehicles, and it is particularly appropriate for motorcycle repair.

OBJECTS OF THE INVENTION

It is an object of the invention to provide a snowmobile repair table and associated frame bracing devices for repairing damaged snowmobiles and similar vehicles.

It is an object of the invention to provide a two-location anchoring system for such a repair system in order to immobilize a vehicle to be repaired.

It is another object of the invention to use a box steel frame for holding the anchoring table as a hydraulic fluid container.

It is yet one further object of the invention to provide a three dimensional pulling/bracing frame that is used in combination with a two-location anchoring table.

It is an additional object of my invention to provide removable braces around the periphery of a working table in order to form a three dimensional pulling system that essentially surrounds a snowmobile vehicle to be repaired.

It is still another additional object of the invention to provide a working table having opposed pairs of chassis clamping devices for immobilizing a vehicle to be repaired.

It is yet one other object of the invention to provide an apparatus which is universally functional with different types snowmobiles, terrain and motorcycles and similar vehicles which need repair.

It is another object of the invention to provide a working method and apparatus having opposed pairs of chassis clamping devices located at both a lower and mid-chassis level for immobilizing a snowmobile vehicle to be repaired.

BRIEF DESCRIPTION OF DRAWING

FIG. 3 depicts views showing the various cooperative parts of the chassis holding clamp of FIG. 2;

DESCRIPTION OF PREFERRED EMBODIMENT (S)

Figures 1, 2:
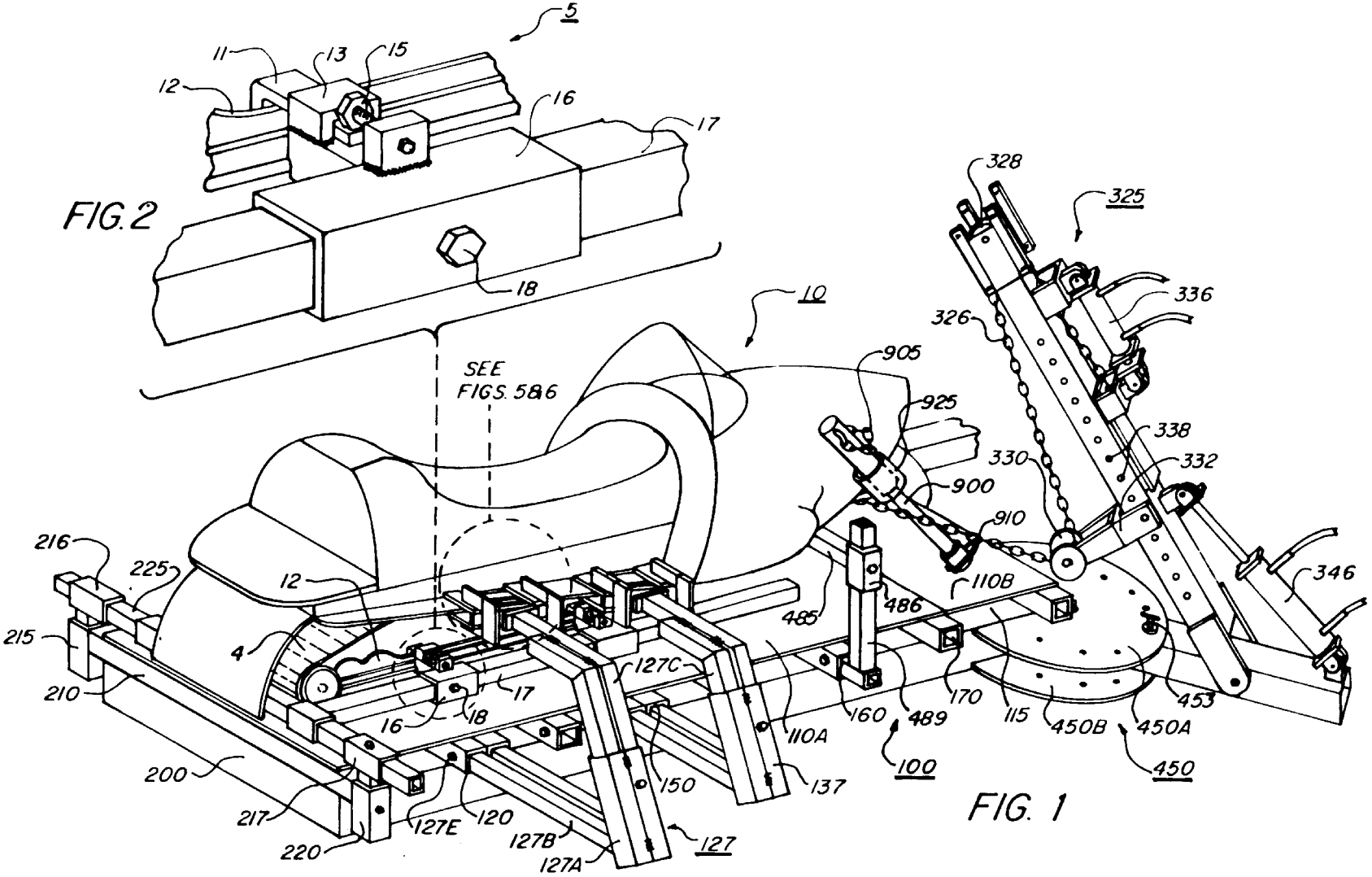
FIG. 1 is a perspective view of my repair system having a damaged snowmobile on a working flat bed table surface.
FIG. 2 is an enlarged partial perspective view of one chassis holding clamp of my system invention.
Figure 4:
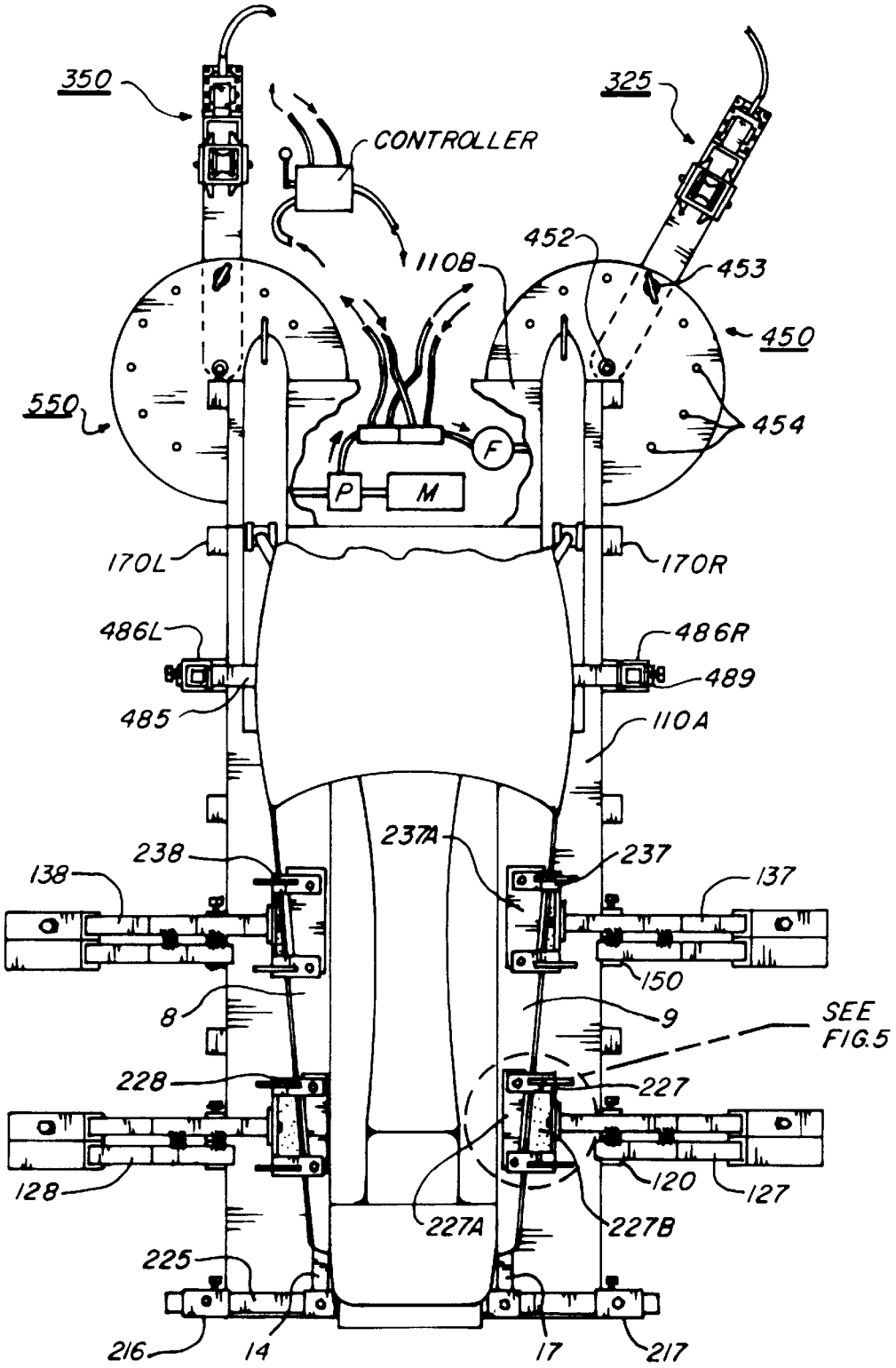
FIG. 4 is a top view looking down on my repair bed and showing a pair of adjustable repair pulling towers and a front fulcrum bar in place together with four suspension running board clamps and associated outrigger braces.

FIGS. 1 and 4 respectively present a partial perspective elevation and a top view of a snowmobile 10 on my frame and body straightening repair system 100. More particularly, the encircled areas of FIG. 1 depicts enlarged views of an anchor clamps which will readily allow a deeper understanding into the principles of my invention. As summarized above, I provide a three-dimensional, self-contained pulling frame system 100 in combination with a two-location anchoring and working table 110A.

Turning now to the details shown in FIG. 1, a snowmobile 10 that requires repair has been placed on the working table surface 110A of my straightening and repair system 100. Working table surface 110A, 110B receives snowmobile 10 on a sturdy upper sheet steel flat bed. Associated with this flat bed surface are various frame and removable/replaceable members for anchoring and pulling in order to repair a damaged snowmobile.

Also associated with, and incorporated at the front of my bed 110A, are a pair of cantilevered and center pivoted pulling towers 325 and 350. These angularly adjustable upright towers are seated in a pair of spaced, three-quadrant mounting platforms 320 and 340 as best shown perhaps by the top view in FIG. 4 and the perspective view of tower 325 in FIG. 1. Such towers will be described in more detail hereinafter.

Surround frame 200 is a large box steel base for the system and frame 200 is formed of members that are welded at their ends into a large rectangular base for table 110A, 110B. In my invention, such individual surround frame members are welded as a continuous hollow conduit that I use for storing hydraulic oil required for the ram pulling and positioning system. Since the surround frame 200 is on the cool surface of a shop area, this affords an ideal location for storing the hydraulic oil in that it remains at a premium and cooler operating temperature.

Additionally, I have separated the front portion 110B of table 110A in order to define, within a front open area of the surround frame 200, a stowage space 115. The stowage space may be under a hinged cover or a loose cover that drops in place and is removable. Within stowage space 115 I have placed the various hydraulic hoses, motors, pumps and filters as are commonly associated with hydraulic fluid power equipment. Such equipment is commonly understood and needs no further description other than the generalized FIG. 4 view of pump 305, hoses 306 and filter 308. Stowing such equipment in the front recess of surround frame 200 allows my system 100 to be self-contained with all controls and units readily available for inspection, repair and replacement as needed.

Around the periphery of table 110A are a series of box steel receiving receptacles such as receptacle elements 120, 150, 160, 170 and the like. For much of the straightening system, box-type steel members are used, since such members not only provide great strength; but, they may readily be mated with, ie. telescoped into or over, other mating-sized box steel members. Such box members in braces and anchors provide rigidity, convenience and resist twisting to a high degree.

Bracing members, preferably in the form of box steel angle braces are removed and fitted in place around the periphery of the repair frame working table 110A as required for a given task. Such members, in some cases, consist of a double side-by-side arrangement in order to rigidly hold my two-location anchor clamps in place. These bracing members are adjustable, removable and in certain specified locations provides several degrees of freedom in order to provide for increased flexibility in anchoring and/or pulling adjustments as required.

I have noted that snowmobile repair is very susceptible to sliding and/or twisting of the entire vehicle when pulling is taking place. Such unwanted vehicle movement has the potential of tending to cause additional damage. Indeed, movement at the wrong time or position can even create more bends and twists by the pulling apparatus. Accordingly, rather than straightening, or repairing, the original damage caused by a snowmobile accident, such movement may cause more harm than good. Of course, other types of members, such as steel pipe may also be used in my invention; but, I prefer box steel members in order to more readily overcome any unwanted twisting and sliding movement during pulls.

Certain ones of these box steel receptacles are in a horizontal plane located between the under surface of the working table 110A and the main box steel surround frame 200. Others are located vertically at specified locations of my system. Such receptacles serve the function of receiving various clamps and braces as will be described in detail hereinafter.

At the very rear of the table 110A between its under surface and the top of the end piece of surround frame 200 is located a horizontal rail 210 that is welded in place with a pair of vertical uprights 215 and 220 welded or otherwise securely attached on each end of rail 210 and to surround frame 200. Such vertical openings can receive removable wheels that may easily be inserted and removed as needed so that my self-contained system may be moved around the shop or from place to place. Similar wheels are available in openings 170 at the front of my system 100.

Rail 210 serves as a fixed rear anchoring rail in order to receive a rear clamp anchoring rail 225 to be secured to it by way of T-shaped anchor stubs 216 and 217. These T-shaped stubs are dropped in place in the vertical openings on rear uprights 215 and 220. Rear clamp bar 225 is thus secured and fixed in place across the end surface of table 110A and parallel with the fixed rail 210. Clamp bar 225 holds a pair 14, 17 of spaced, adjustable longitudinal clamp runs.

Run 14 is on the left side and clamp run 17 is on the right side of table 110A (sides refer to the front of the table where the pulling towers 325 and 350 are located.) The snowmobile front is normally located at the front of the table 110A. Obviously, if some damage is done to the rear of snowmobile, its direction can be reversed on the flat bed table 110A and still be anchored in place in accordance with my invention. Regardless of the snowmobile direction on table 110A, my system utilizes up to four individual chassis clamps such as clamp 5 shown encircled on FIG. 1, and up to four running board clamps 285 shown encircled on FIGS. 1 and 4.

As noted earlier, for satisfactory repair, I have discovered that both the chassis 12—the main frame of a snowmobile—and the suspension system—via snowmobile running boards 8 and 9—must be properly and securely immobilized. Such snowmobile immobilization, or anchoring, as I call it, is done preferably by two opposed pairs of lower and mid-level clamps. Up to four clamps are available on each lower and mid level position.

The lower clamps 5 are designed to reach within the track 4 and secure the snowmobile slide rails 12 by at least one pair of opposed slide rail clamps 5. Two clamps 5 along each side of a pair of slide rails of a snowmobile are provided. Clamps 5 may be adjusted in position along clamp runs 14 and 17 as need and then tightened in place. When adjusted and tightened in place such clamps 5 lock both slide rails 12 of a snowmobile chassis in place on the working table surface 110A. This slide rail portion of a snowmobile chassis is one of the locations for my novel two-location anchoring system provided by my invention.

FIG. 2 shows an enlarged view of a slide rail clamp 5 and the various sliding and locking and clasping elements. Sliding collar 16 is secured to the clamp run bar 17 by bolt 18 through a commonly understood locking fixture. Thus, I afford flexibility to lock collar 16 in a proper location for various snowmobile types by securing clamp 5 proper to the clamp run 17 via tightening of compression bolt 18. A right angle tongue 11 of clamp 5 may be threadably advanced and/or retracted in a lock slide area under bracket inverted U bracket 13 by thread/nut unit 15 in a commonly known manner that is not believed to require any further description.

The various views of FIG. 3 show additional details of clamp 5 which I have used advantageously in snowmobile repair via my novel system 100. Such views are mostly self explanatory and are submitted for sake of completeness. FIG. 3C shows an enlarged cross section of one typical slide rail 12 and depicts how I have located a lower indentation 6A in the anvil face 6 so that various types of slide rails may be securely anchored. Various anvil faces are provided as necessary to accommodate differing cross sectional features of slide rails of different snowmobile types.

The design of snowmobiles requires that my system must accommodate various right and left hand side pull, anchor, clamps, braces and the like as explained herein. For example, right and left handed running board features must be accommodated. The suspension system of the snowmobile—as reflected at the left running board 8 and the right running board 9—must be immobilized. Bracing for the running board clamps, in particular, should be of a double, side-by-side configuration in order to prevent any twisting of the snowmobile frame as repair pulls are ongoing.

Returning to FIG. 1, depicted on the right hand side of the table 110A (relative to the normal forward position of a snowmobile 10) are located opposed pairs of double-spaced openings 120 and 150. Such double—or twin receptacles—in turn, receive double-welded and double-angled telescoping outrigger braces 127 and 137.

Referring first to brace 127, it comprises several separate sections. The lower section 127A of brace 127 is welded at an acute angle of about 45° to horizontally positioned double-welded box steel bars 127B that are, in turn, inserted into openings 120. When the position of the bars 127B are correct, as far as the position of the running board clamp 227 is concerned, bolt 127E may be tightened in order to lock bars 127B into openings 120 at the correct position. Such an approach provides a sturdy lower outrigger bracing for cooperation with another adjustable upper angled section 127C that may be adjustably seated into the lower angled section 127A.

Clamp 227 is rigidly held at the inner end of section 127C and that clamp may be tightened into place on the rear right section of running board 9. Snowmobile running boards generally have a rolled edge at the outboard side and proceed from a narrow foot space at the snowmobile rear to a broader foot space at the snowmobile front near the cowling, or tunnel, as it is commonly called.

Figure 5C:
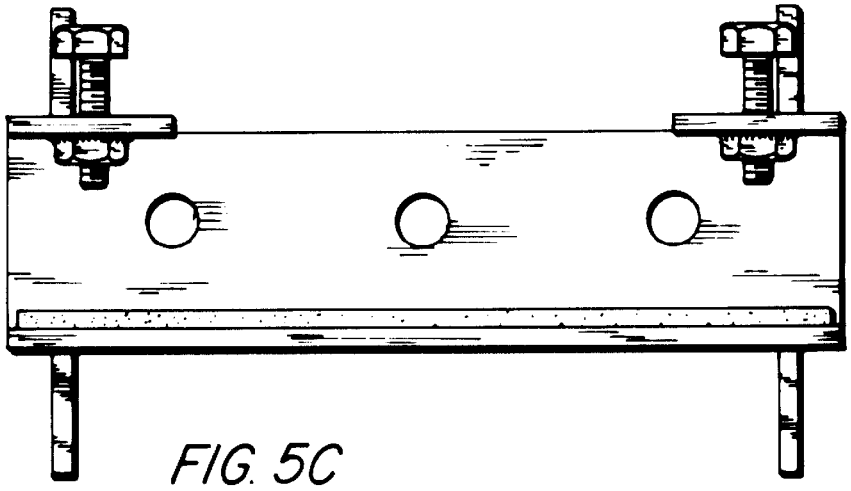
FIG. 5 includes FIGS. 5A, 5B, and 5C all being respectively separate views of a running board suspension clamp, which clamp together with the slide rail clamp of FIG. 2 assures a two-location snowmobile anchor on the flat bed repair table.
Figure 5B:
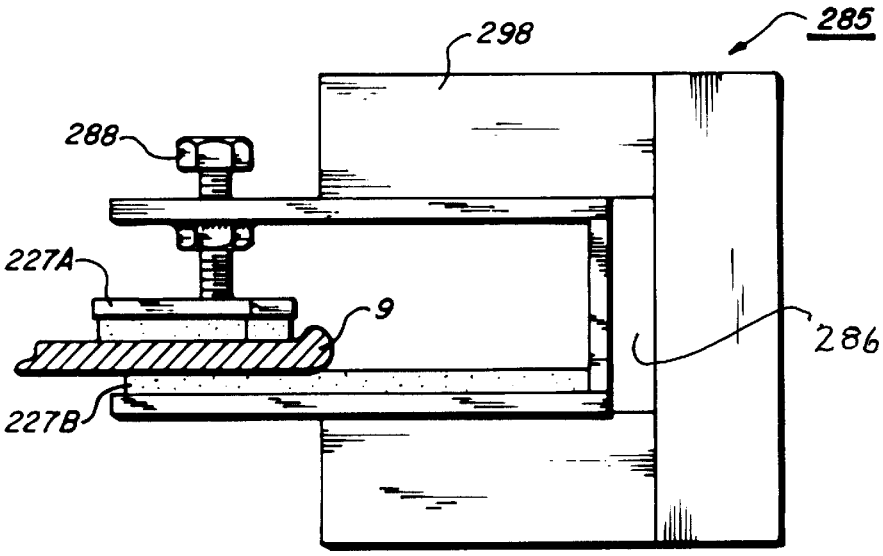

My clamps 227 and 237, FIG. 4, secure the suspension by seizing the upper running board surface between appropriately shaped upper and lower locking pads that may be tool driven into a grasping and holding position on running board 9. One such clamp 227 is shown in an enlarged view in FIG. 5B. As there depicted pad 227A and pad 227B may firmly be locked unto running board 9 when a craftsman tightens the upper drive bolt 288. These locking pads come into contact on the upper surface of the running board while wider pads 227B seize the lower side of the running boards.

Figure 5A:
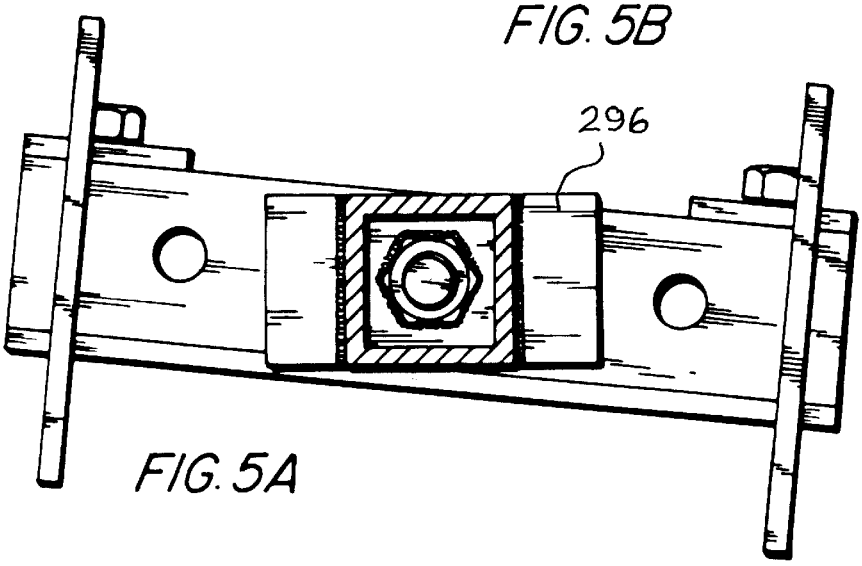
Figure 6:
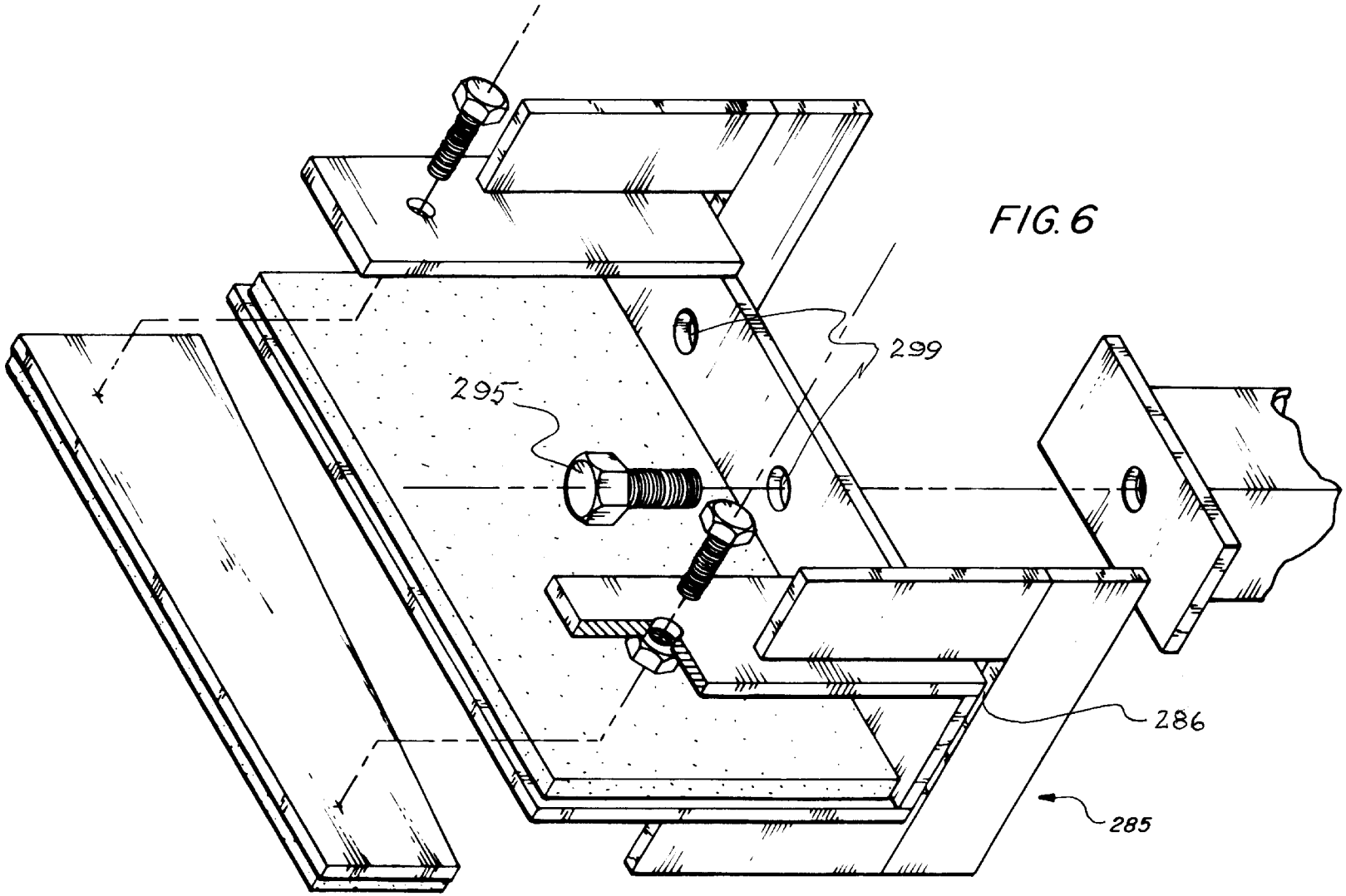
FIG. 6 is an exploded view of the running board/suspension clamp shown in FIG. 5; and, more particularly, is an exploded side perspective view of the running board clamp shown in FIG. 5B.

The exploded view of FIG. 6 clearly depicts the cooperation of pads 227A and 227B in grasping and securing running board 9. Two tightening bolts 288 are located at each end of the reverse C yoke 298 so that a larger share of the running board may be secured. For flexibility in movement for different types of snowmobiles, a series of mounting holes 299 are located at the base of the yoke. Bolt 295 threads into a securing plate 296 that is welded or otherwise fixed to the inner end of 127C. Plate 236 has tabs on each end that fit within spaces 286 when bolt 295 is moved to the extreme end locations. Given the self explanatory nature of FIGS. 5 and 6, no further explanation of clamp 227 is believed to be required Repair work can be accomplished by pulling equipment associated with the repair frame. At the front of my system are a pair of towers 325 and 350 These are the primary source of pulling strength for my system, and each tower includes a pair of rams 336 and 346. Ram 336 provides pulling force through chains and pulleys, while ram 346 is for tower positioning at angles away from a normal vertical tower position. These pulling towers are structurally incorporated at circular tracks 450 and 550 located at the front end of the working table.

Associated with such towers are chains 326, ram control hoses 327, pulley(s) 328, and the like for delivering pulling or adjusting force as required during snowmobile repair. Towers 325 and 350 are each rotatable adjustable in about 270 degrees of swinging freedom between the associated pairs of spaced circular segment mounting tracks 450A and 450B.

The rotational movement afforded such towers is achieved by a center located pivoting pin 452 and an associated tower locking pin 453 seated through holes 454 around the outside periphery of circular segment tracks 450A and 450B. A craftsman may easily adjust the location of a tower by use of pivot 452 and reset the towers horizontal angular location by selective use of pin 453.

The circular segments of plates 450 and 550 provides a wide latitude in direction of angular pulls on the snowmobile. Pulling is done in a standard fashion by chains and ram 336. The location of ram 336 is fixed, but the location of yoke 332 holding pulley 330 on each tower is adjustable in openings 338 running along the length of tower 325. Such openings, together with user re-positioning of yoke 332 and pulley 330, provide ample flexibility in accommodating many different repair situations.

Additionally, each of these pulling towers 325 and 350 are also adjustable by any desired angular amount relative to a vertical axis, which axis is normally perpendicular to the pivot pin location. Tilting ram 346, FIG. 1, is controllably used to vary the angle of attack of the pulling chain 326 as it passes over the top pulley block 328 and changes direction around yoked pulley 330.

As ram 336 is controllably driven away from its anchor position on tower 325, chain 326, travelling along the tower's longitudinal axis and through the described pulleys, delivers a pulling force at a selected angular position both horizontally and vertically. Cantilever mounting of the towers provides additional tilting, pivoting and heights-of-pull adjustments.

In short summary then, a change of direction chain pulley 330 feeds the pulling chain 326 at a selected height and angle for either an upright or angled tower as set by the craftsman for a particular pull as he deems necessary. As can be appreciated, the crash damage to high speed snowmobiles can be considerable and at varying locations. Such vehicles are characterized by lightweight and rather flimsy materials so that they may attain high speeds with relatively low horse powered engines.

Should an accident cause crash damage to the front portion of a snowmobile, my invention also provides an adjustable fulcrum bar 485, FIGS. 1 and 4. Fulcrum bar 485 is fastened to collar 486 which, in turn, is telescoped over an upright 489 that is seated in receptacle 160. A similar bracing set up (not shown in FIG. 1) is used on the opposite side of snowmobile 10 as shown by the top view of FIG. 4.

Fulcrum bar 485 can be snugly placed under the sled chassis frame and just in front of the track 4. Fulcrum bar 485 then acts as a lateral wedge under the front hood area in order to hold the front of the snowmobile immobile while varying angled pulls are developed from different height and spacial locations, generally, by use of an angled tower 325, FIG. 1 or tower 350, FIG. 4.

In the example of FIG. 1, a forward ski and shock carrier has been damaged. For repair the shock should be removed and replaced by a steel bar replacement pulling strut 900. In some particular makes of snowmobiles, the shock absorber holders themselves may also require straightening but the shock absorbers, if chains are placed on them, will not stand the bending forces needed for repair.

In such an event, I have discovered that it is advantageous to first remove those shocks and replace them by a puller bar 900 that has a pulling chain loop 905 and a solid pull loop rod 910, respectively, located above and below a straight steel pulling bar 900 which is adapted to fit within the shock absorber carrier 925 on snowmobile 10. This technique and aspect of my invention lowers repair costs and reduces inconvenience.

Figure 7:
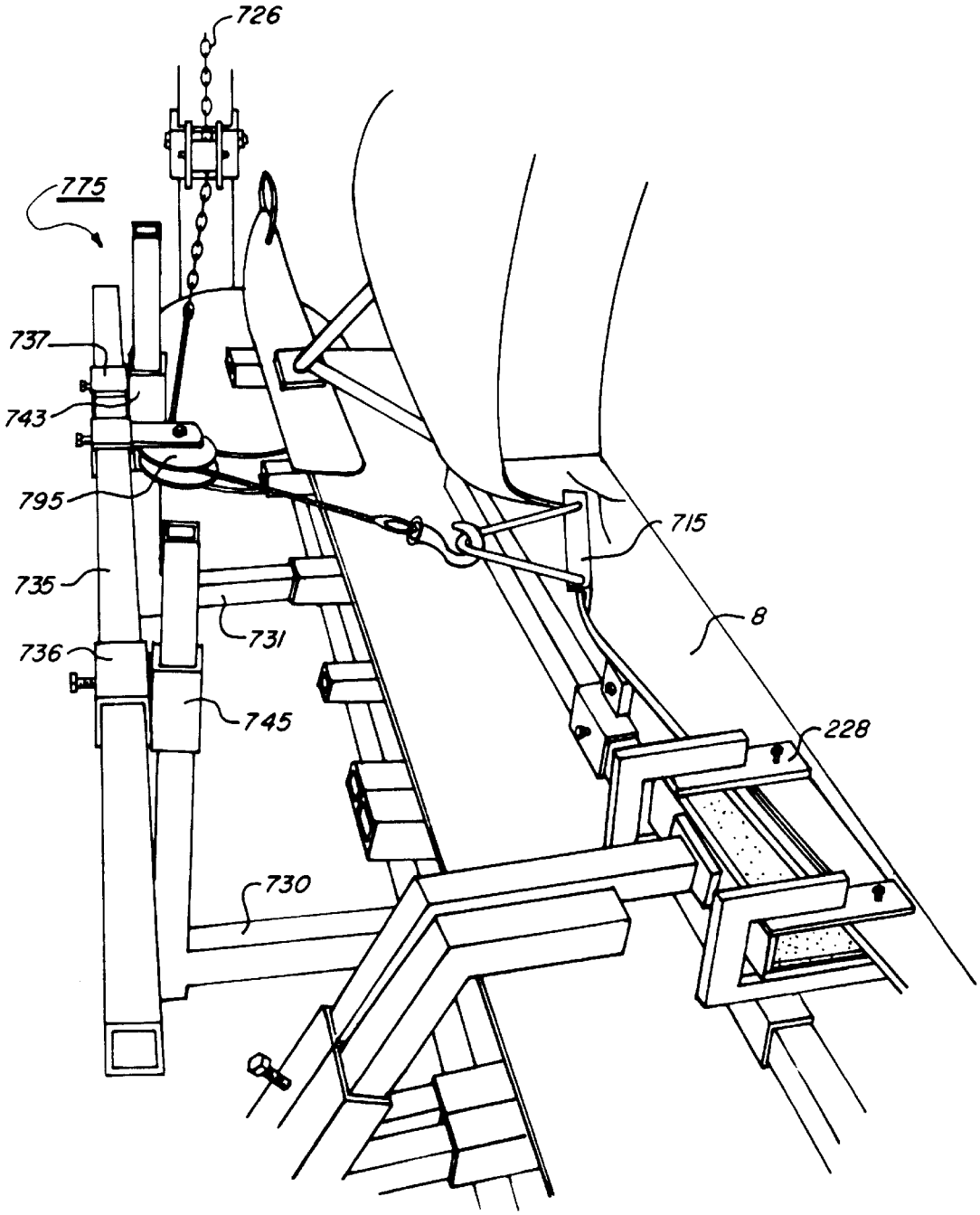
FIG. 7 is a side perspective view showing side bracing and change of direction pulleys for applying a side pull as required for repair of a damaged running board area at the left hand side of a snowmobile or similar vehicle.

Should an accident cause damage to a running board area, the running board clamp at that damaged area need not be installed as shown by FIG. 7. In FIG. 7, the front left hand clamp 238, FIG. 4, is not in place in order to expose a working area for a side pull against the running board 8. During such a side pull, of course, the multiple redundancy of the other seven clamps keep snowmobile 10 immobilized as the pull takes place. Thus, the other three running board clamps—such as clamps 227, 237, 228 and all four opposed slide rail clamps 5 work together to anchor snowmobile 10 in place.

In such an instance, the repair pulls are applied to the damaged running board area using a running board puller 715 that seats over the rounded edge of running board 8. And, if necessary, puller 715 may be held in place on running board 8 by a series of C-clamps (not shown) as required to hold it in place during a pull.

In FIG. 7, please note that I have developed a side bracing system—vertical and horizontal—that is adjustable in multi-directions. I use right-angle uprights 730 and 731 having collars 743 and 745 riding on the vertical leg of the angle uprights. Collars 743 and 745, in turn are welded or otherwise fastened to adjustable collars 736 and 737 which hold a horizontal brace bar 735 at whatever location best serves for the desired pull. Braces 775 will thus assure a several-direction and adjustable side pull by ram-driven chain 726 and pulley 795.

Many other varied location clamps and pulls are readily available by my apparatus and method. Additionally I have used the box steel support frame which underlies my working repair table as a cooling and circulating reservoir system for the hydraulic fluid system required by the pulling rams. The front end of my frame/working table has a lift lid that conceals a front surround frame area which houses the hydraulic pumps and filtering system required for driving/controlling the various pulling rams.

In short summary then, what I have perfected is a new and novel method and apparatus that consists of a three dimensional self-contained pulling frame that is used in combination with a two-location anchoring/working table capable of holding a snowmobile in place by a total of eight separate yet adjustable points. While my invention is particularly applicable to snowmobiles, it is not so limited. I have successfully used my apparatus on various types of smaller terrain vehicles, and it should be particularly appropriate for repair of motorcycles as well.

While my invention has been described with reference to a particular example of a preferred embodiment, it is my intention to cover all modifications and equivalents within the scope of the following claims. It is therefore requested that the following claims, which define my invention, be given a liberal interpretation which is within the spirit and scope of my contribution to this art.

What is claimed is:

1. A self-contained vehicle straightening repair system which includes a working and anchoring table for receiving, for repair pulls, a vehicle having both a suspension and a chassis assembly, said straightening system comprising:

a combination two-location anchoring and working table which assures that both the chassis and the suspension of the vehicle are immobilized relative to said table;

repair pulling equipment mounted on and associated with said table;

said two-location table having anchoring means fixably adjustable adjacent to an upper surface of said table for immobilizing the vehicle chassis relative to said table;

said two-location anchoring table having suspension means on braces held in selected openings around the periphery of said table for grasping a body portion of said vehicle to assure an anchoring in place of the vehicle's suspension; and means associated with said repair pulling equipment for applying pulls to the immobilized vehicle in order to straighten and repair vehicle damage.

2. A repair system in accordance with claim 1 wherein said vehicle is a snowmobile having a slide rail as the main chassis of the vehicle and the running board of said vehicle representing the suspension of the snowmobile, and said two-location anchoring means is further characterized by comprising:

at least one pair of opposed running board clamps for clamping the suspension of the snowmobile in an anchored and fixed position relative to said table; and at least one pair of opposed slide rail clamping means for locking both slide rails of a snowmobile chassis in a fixed place relative to said table.

3. A repair system in accordance with claim 2 wherein said snowmobile anchoring means is further characterized by comprising:

a pair of longitudinal clamp runs slidably fixable in a selected position along the length of said table, with at least one clamp run being located on each side of said snowmobile; and a fixed bar at the rear of said table for fixing said clamp run pair in a securely locked position at the rear of said table.

4. A repair system in accordance with claim 2 wherein said snowmobile anchoring means is further characterized by comprising:

up to four separate slide rail anchoring clamps carrier by said pair of clamp runs for securely grasping the slide rails of said snowmobile at four separate spaced locations.

5. A repair system in accordance with claim 2 wherein each side of a snowmobile body includes a running board and said snowmobile anchoring means is further characterized by comprising:

rigid outrigger side braces, at least one side brace for each side of said table, held in openings around the periphery of said table and having extension(s) to the running board of the snowmobile; and at least one pair of opposed adjustable running board clamps, at least one clamp for each side brace, fixedly mounted on the extension of said side braces and adjustable by a user for grasping each one of the running boards in order to immobilize the suspension of the snowmobile.

6. A repair system in accordance with claim 2 wherein said snowmobile anchoring means is further characterized by comprising:

up to four separate running board anchoring clamps, with each clamp carried by a side outrigger brace for securing both the right and the left running boards of said snowmobile at up to four separate spaced running board locations.

7. A repair system in accordance with claim 5 wherein said side braces further comprise;

box steel angle brace members which are user-removable from said peripheral openings of said table and are selectively lockable in place around the periphery of said table by locking means.

8. A repair system in accordance with claim 7 wherein said side bracing members, in order to prevent any twisting or sliding of the snowmobile frame as repair is ongoing, further comprises:

said box steel members include double, side-by-side welded box steel construction of improved rigidity; and collar and telescoping means associated with said running board clamps providing several directions of fixedly adjustable movement for increased user flexibility in anchoring adjustments as necessary to immobilize and pull said snowmobile during repair.

9. A vehicle repair system in accordance with claim 1 wherein said table has a pair of front corners and said system is further characterized by comprising:

a pair of upright pulling towers, each tower having pulling chains and power rams, with said towers structurally mounted at circular segment tracks integrally fixed in position at said front corners of said table.

10. A repair system in accordance with claim 9 and further characterized by comprising:

each of said upright pulling towers may be adjusted horizontally by rotation in said circular segment tracks through about 270° of movement, and said table further comprises user settable pins for locking said towers in place by locking fixtures provided on said circular segment tracks.

11. A repair system in accordance with claim 9 and further characterized by comprising:

tower tilting means for each of said pulling towers, said tilting means assuring that each tower is also individually and angularly adjustable by any desired angular amount relative to a vertical axis along the tower's mounting location.

12. A repair system in accordance with claim 11 and further characterized by comprising:

an adjustable, yoked change of direction chain pulley mounted on each tower;

said pulleys each feeding a pulling chain at a selected height and angle for either an upright or angled tower; and a pair of hydraulic rams carried by each tower—one ram controllably supplies a pulling force—and the other ram being part of said tilting means and responsive to a users control for controllably setting and holding a selected angular adjustment of each tower.

13. A repair system in accordance with claim 1 wherein said vehicle is a snowmobile and damage to said snowmobile may be in the front portion thereof, and said working/anchoring table for said straightening system further comprises:

an adjustable fulcrum bar that can be placed under the snowmobile chassis frame and in front of the snowmobile track, said fulcrum bar mounted across uprights on the front of said table in order to act as a lateral wedge for holding the damaged front portion of the snowmobile chassis frame relatively immobile; and means associated with said repair pulling equipment for developing varying angled pulls from below said fulcrum bar.

14. A repair system in accordance with claim 1 wherein said vehicle is a snowmobile and damage to said snowmobile may be in the sides thereof, and said table for said straightening system further comprises:

means providing for removal of a running board clamp and outrigger brace at damaged snowmobile side area;

clamping braces extending from said table along the side thereof and in the general area of the removed running board clamping braces; and means for applying repair pulls to a damaged side area aligned with said side anchoring braces.

15. A repair system in accordance with claim 1 wherein said vehicle is a snowmobile having damage in the shock absorber area which includes a shock absorber holder mounted on the snowmobile,—which shock absorbers may not stand the bending forces needed for repair—and said table for said straightening system further comprises:

a rigid strut replacement bar to take the place of a removed snowmobile shock; said replacement bar having a dimension adapted to be housed in the mounted shock holder of the snowmobile; and pull receiving means on said replacement bar for receiving a pull from said pulling equipment.

16. A repair system in accordance with claim 1 wherein the pulling equipment includes hydraulic rams and an associated control which require a quantity of hydraulic fluid, and said system further comprises:

a box steel support frame underlying said table in the form of a hollow conduit;

a cooling and circulating reservoir for the hydraulic fluid within said support frame; and hydraulic fluid inlet and outlet means for said hollow conduit of said support frame.

17. A repair system in accordance with claim 16 and wherein said table further comprises:

a lift lid section in the fore part of said table; and a front area of said support frame which houses hydraulic pumps motor, hoses, and filtering supplies as required for driving and/or controlling said hydraulic pulling equipment.

18. A method of straightening a snowmobile comprising the steps of:

placing a snowmobile on a three dimensional self-contained pulling table;

affixing a two-location anchoring system on said table capable of fixedly holding a snowmobile in place on said table; and providing a total of up to eight separate yet adjustable clamping points on said table for applying straightening pulls on said snowmobile while same is fixedly held on said table by said two-location anchoring system.

19. A method of straightening a snowmobile having both a snowmobile suspension system and a snowmobile slide rail assembly, which method comprises the steps of:

placing a snowmobile to be repaired on a combination working and anchoring table;

anchoring both the chassis and the suspension of the snowmobile on said table;

placing repair pulling equipment around the periphery of said table; and applying pulls to the immobilized snowmobile for straightening and repair of the damaged snowmobile.

20. A method of straightening a snowmobile in accordance with claim 19 and further comprising the additional method steps of:

chassis anchoring the snowmobile slide rails in a fixed position adjacent to an upper surface of said table;

suspension anchoring the snowmobile suspension by means of braces held in selected openings around the periphery of said table; and grasping both a right and a left running board of said snowmobile at a pair of points fore and aft on each running board to provide said suspension anchoring.

21. A snowmobile repair apparatus comprising:

a three dimensional pulling table for receiving a damaged snowmobile;

a two-location anchoring system on said table capable of fixedly holding said snowmobile in place on said table; and a plurality of separate adjustable clamping and pulling means on said table for repairing said snowmobile while the same is held in place on said table by said anchoring system.

22. A snowmobile repair apparatus in accordance with claim 21 wherein said pulling table has a corner, and said clamping and pulling means is further characterized by comprising:

a least one angularly adjustable upright pulling tower rotationally mounted at a circular segment track affixed at a corner of said pulling table.

* * * * *